US010900763B2

(12) United States Patent
Hucker et al.

(10) Patent No.: US 10,900,763 B2
(45) Date of Patent: Jan. 26, 2021

(54) ACTIVATING A FUSE

(71) Applicant: BAE SYSTEMS plc, London (GB)

(72) Inventors: Martyn John Hucker, Bristol (GB); Stephen John Atkinson, Usk (GB)

(73) Assignee: BAE SYSTEMS plc, London (GB)

( * ) Notice: Subject to any disclaimer, the term of this patent is extended or adjusted under 35 U.S.C. 154(b) by 278 days.

(21) Appl. No.: 15/998,580

(22) PCT Filed: Feb. 8, 2017

(86) PCT No.: PCT/GB2017/050305
§ 371 (c)(1),
(2) Date: Aug. 16, 2018

(87) PCT Pub. No.: WO2017/141007
PCT Pub. Date: Aug. 24, 2017

(65) Prior Publication Data

US 2020/0278186 A1 Sep. 3, 2020

(30) Foreign Application Priority Data

Feb. 16, 2016 (EP) ..... 16275025
Feb. 16, 2016 (GB) ..... 1602700.5

(51) Int. Cl.
*F42C 17/04* (2006.01)
*F42C 13/08* (2006.01)

(52) U.S. Cl.
CPC ..... *F42C 17/04* (2013.01); *F42C 13/08* (2013.01)

(58) Field of Classification Search
CPC ..... F42C 13/08; F42C 13/006
(Continued)

(56) References Cited

U.S. PATENT DOCUMENTS

H081 H * 7/1986 Szabo ..... 346/38
5,423,262 A * 6/1995 Pettersson ..... F42C 13/08 102/212

(Continued)

FOREIGN PATENT DOCUMENTS

DE 102013017331 A1 4/2015
EP 0596845 A1 5/1994

(Continued)

OTHER PUBLICATIONS

International Preliminary Report on Patentability received for Patent Application No. PCT/GB2017/050305, dated Aug. 30, 2018. 5 pages.

(Continued)

*Primary Examiner* — Samir Abdosh
(74) *Attorney, Agent, or Firm* — Finch & Maloney PLLC

(57) ABSTRACT

According to an aspect of the invention, there is provided a communication system for communicating between a ranged weapon and a projectile for that ranged weapon, the system comprising: a transmitter associated with the ranged weapon, the transmitter being arranged to encode data to be transmitted to the projectile on an electromagnetic carrier wave, and to transmit that electromagnetic carrier wave to the projectile; a receiver associated with the projectile, the receiver being arranged to receive the electromagnetic carrier wave, and to decode data encoded in the electromagnetic carrier wave to retrieve that data, the data being usable in the activation of a fuse of the projectile.

20 Claims, 7 Drawing Sheets

Figure 1:
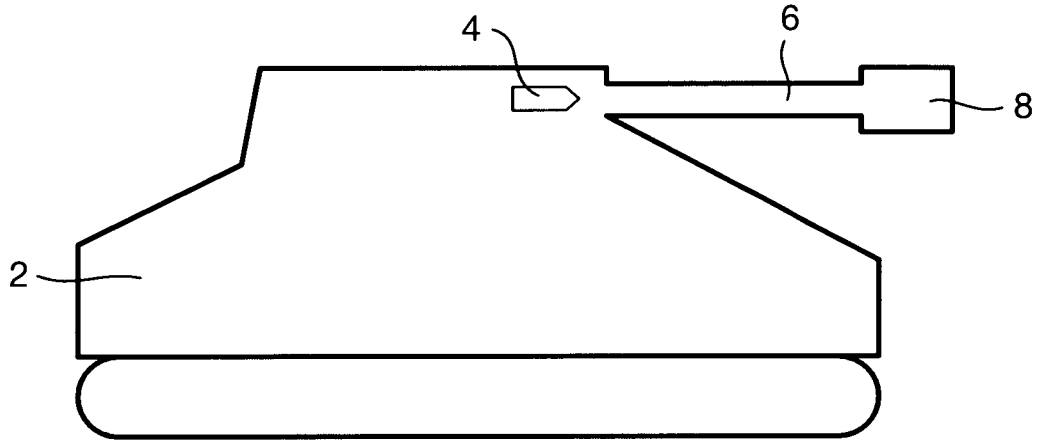

(58) Field of Classification Search
USPC ..... 102/212; 89/6, 6.5
See application file for complete search history.

(56) References Cited

U.S. PATENT DOCUMENTS

| | | | | |
|---|---|---|---|---|
| 5,444,669 | A * | 8/1995 | Polvani | F41G 9/008 367/96 |
| 6,176,168 | B1 * | 1/2001 | Keil | F42C 17/04 102/215 |
| 6,295,931 | B1 * | 10/2001 | Cutler | F42C 13/08 102/221 |
| 8,800,359 | B2 * | 8/2014 | Furch | F42B 15/08 73/167 |
| 10,746,519 | B2 * | 8/2020 | Hucker | F42C 13/006 |
| 2007/0074625 | A1 * | 4/2007 | Seidensticker | F42C 11/065 89/6.5 |
| 2010/0308152 | A1 * | 12/2010 | Seidensticker | G05D 1/108 244/3.17 |
| 2019/0323807 | A1 * | 10/2019 | Smith | F42B 15/01 |
| 2020/0116465 | A1 * | 4/2020 | Hucker | F42C 11/065 |
| 2020/0278186 | A1 * | 9/2020 | Hucker | F42C 13/08 |

FOREIGN PATENT DOCUMENTS

| | | | | |
|---|---|---|---|---|
| EP | 0661516 | A1 * | 12/1994 | F42C 1/00 |
| EP | 0661516 | A1 | 7/1995 | |
| EP | 1813905 | A2 | 8/2007 | |
| EP | 2600097 | A1 | 6/2013 | |
| WO | 2017/141007 | A1 | 8/2017 | |
| WO | 2017/141009 | A1 | 8/2017 | |

OTHER PUBLICATIONS

International Preliminary Report on Patentability received for Patent Application No. PCT/GB2017/050307, dated Aug. 21, 2018. 11 pages.

International Search Report and Written Opinion received for Patent Application No. PCT/GB2017/050307, dated Apr. 25, 2017. 14 pages.

GB Intellectual Property Office Search Report under Section 17(5) received for GB Patent Application No. 1602703.9 dated Oct. 19, 2016. 3 pages.

Extended European Search Report received for EP Application No. 16275026.9 dated Aug. 31, 2016. 9 pages.

International Search Report and Written Opinion received for Patent Application No. PCT/GB2017/050305, dated Apr. 24, 2017. 15 pages.

GB Intellectual Property Office Search Report under Section 17(5) received for GB Patent Application No. 1602700.5 dated Oct. 19, 2016. 3 pages.

Extended European Search Report received for EP Application No. 16275025.1 dated Jul. 21, 2016. 8 pages.

* cited by examiner

ACTIVATING A FUSE

The present invention relates generally to activating a fuse of a projectile for a ranged weapon, and more particularly to apparatus and methods for use in such activation.

A projectile, for example a shell or similar, may be fired from a ranged weapon. The ranged weapon may, for instance, be a tank, a piece of artillery, and so on—something that can fire a projectile over a distance. The projectile can be used in one of a number of ways. A fuse within the projectile can be activated, in order to detonate, burst or otherwise explode the projectile, on impact of the projectile onto another object, for example a target object or target location. However, it may not always be necessary or desirable to require impact of the projectile in order to cause explosion of the projectile by activation of its fuse. In another example, it may be desirable for the projectile to air-burst—i.e. explode or similar without impact. Of course, in such an example the fuse of the projectile needs to be activated by something other than impact of the projectile.

There have been previous attempts to design a projectile with a fuse system that is capable of being activated, without impact of the projectile, at a target location. In one instance, the fuse of such a projectile might be activated based on a timer within the projectile that is activated or initiated upon firing of the projectile. An initial, or muzzle velocity of the projectile is assumed as a typical or otherwise predetermined velocity, and used in a calculation where such velocity, and the timer, can be used to activate the fuse at a certain distance from a firing origin location. If the actual muzzle velocity is the same as the predetermined or assumed velocity, then this approach can be used to quite accurately control the location at which air-burst of the projectile takes place. However, in practice, there can be quite a wide range in the actual muzzle velocity, meaning that a pre-determined muzzle velocity used in a distance-to-burst calculation is not always accurate. Of course, it is desirable to improve the accuracy of such air-burst projectiles, wherever possible and practical.

One approach to improving the air-burst timing accuracy has been to use the rotation of a projectile about its longitudinal axis (e.g. its turn count) during the projectile's trajectory from firing origin to target location. The rotation of the projectile about its longitudinal axis is largely determined by the rifling of the barrel from which the projectile is fired. So, the rotational rate or frequency of the projectile is known in advance. Therefore, if the projectile is known to rotate a certain number of times from firing, possibly with some in-built calibration for rotational rate decay due to air resistance or similar, then the fuse within a projectile can be activated when a certain number of turns have been counted. This turn-count will equate to a certain distance from the firing origin, which can be used to ensure that the projectile air-bursts at a particular distance from the firing origin, or in other words at a particular target location.

The turn-count approach might have a reduced margin of error when compared with the use of assumed muzzle velocity or turning information in isolation. However, this assumption is based on the turn-count being measured accurately and consistently. Such measurement is not always the case. For instance, with current electro-mechanical sensors or similar, it may not be possible to sense the rotational frequency of the projectile with sufficient accuracy, if at all. More recently, an approach has been suggested where electro-mechanical sensors are not used, and instead a magnetic field sensor is used in their place. Although an approach using magnetic field sensors might avoid some of the problems associated with electro-mechanical sensors, the suggested magnetic field sensor approach also has disadvantages and drawbacks. For example, depending on the relative positions or orientations between the projectile or its fuse system and the magnetic field, the sensors might have difficulty in determining or sensing changes in position or orientation of the projectile relative to that field.

In general, then, present methods and apparatus for activating a fuse of a projectile are not sufficiently accurate or reliable.

It is therefore an example aim of example embodiments of the present invention to at least partially obviate or mitigate at least one disadvantage of the prior art, whether identified herein or elsewhere, or to at least provide a viable alternative to existing apparatus and methods.

According to a first aspect of the invention, there is provided a fuse system for a projectile for a ranged weapon, the fuse system comprising: a plurality of magnetic field sensors, each sensor being arranged to provide a signal that changes in response to a relative change in position and/or orientation between the system and the Earth's magnetic field, and wherein each sensor has a different alignment in terms of magnetic field sensitivity, and a controller arranged to receive one or more signals from the plurality of magnetic field sensors, and to activate a fuse of the projectile depending on the received one or more signals.

The system might comprise three sensors, and each sensor might have a different alignment in terms of magnetic field sensitivity.

The different alignment in terms of magnetic field sensitivity might be an orthogonal alignment.

The controller might comprise a turn counter, arranged to count a number of turns the projectile makes about a longitudinal axis of the projectile, using the one or more received signals. The controller may be arranged to activate the fuse at a particular turn count.

The controller might be arranged to apply a band pass filter and/or a phased lock loop filter to the received signals, to at least partially filter out signals outside of a turn frequency ranged of interest.

The controller might be arranged to infer a particular change in location of the projectile from the one or more received signals. The controller might be arranged to activate the fuse when the particular change equates to the projectile being at a target location.

The controller might be arranged to infer a particular change in location of the projectile from the one or more received signals based on a known firing origin of the projectile.

The one or more received signals, and/or the firing origin, and/or the target location, may be at least indicative of a known or sensed magnetic field vector angle and/or a known or sensed magnetic field strength, and/or a known or sensed change in a magnetic field vector angle and/or magnetic field strength.

The magnetic field sensor might be one or more of: an active magnetic field sensor; a fluxgate sensor or a magnetoresistive sensor; a sensor that is capable of detecting magnetic fields in the ranged of 25-65 μT, and/or changes in a magnetic field of 25-65 nT.

The fuse system might be arranged to store data that comprises or is at least indicative of one or more of: priming information; and/or timing information; and/or a muzzle velocity of the projectile; and/or a particular turn count number; and/or magnetic field information; projectile firing origin information; and/or projectile firing origin information in the form or magnetic field strength information and/or magnetic field vector angle information; and/or projectile target location information; and/or projectile target location in the form or magnetic field strength information and/or a magnetic field vector angle information.

The controller might comprise a receiver, the receiver being arranged to receive an electromagnetic carrier wave, and to decode data encoded in the carrier wave to retrieve that data.

The receiver might be arranged to decode the data by detecting the presence or absence of particular sub-carriers on the carrier wave, the data optionally being usable by the controller in the activation of the fuse of the projectile.

The data might comprise or be at least indicative of one or more of: priming information; and/or timing information; and/or a muzzle velocity of the projectile; and/or a particular turn count number; and/or magnetic field information; projectile firing origin information; and/or projectile firing origin information in the form or magnetic field strength information and/or magnetic field vector angle information; and/or projectile target location information; and/or projectile target location in the form or magnetic field strength information and/or a magnetic field vector angle information.

According to a second aspect of the invention, there is provided a projectile for a ranged weapon, the projectile comprising the fuse system the first aspect of the invention.

According to a third aspect of the invention, there is provided a method of activating a fuse of a projectile for a ranged weapon, the method comprising: using a plurality of magnetic field sensors of the projectile to provide one or more signals that change in response to a relative change in position and/or orientation between the projectile and the Earth's magnetic field, each sensor having a different alignment in terms of magnetic field sensitivity, and activating the fuse of the projectile depending on the received one or more signals.

According to a fourth aspect of the invention, there is provided a communication system for communicating between a ranged weapon and a projectile for that ranged weapon, the system comprising: a transmitter associated with the ranged weapon, the transmitter being arranged to encode data to be transmitted to the projectile on an electromagnetic carrier wave, and to transmit that electromagnetic carrier wave to the projectile; a receiver associated with the projectile, the receiver being arranged to receive the electromagnetic carrier wave, and to decode data encoded in the electromagnetic carrier wave to retrieve that data, the data being usable in the activation of a fuse of the projectile.

The data might be encoded in binary form by the presence or absence of particular sub-carriers on the carrier wave, and/or the receiver may be arranged to decode the data by detecting the presence or absence of particular sub-carriers on the carrier wave.

The communication system might further comprise a controller associated with the projectile, the controller being arranged to activate a fuse of the projectile using the received data.

The controller may be additionally arranged to activate a fuse of the projectile using one or more signals received from one or more magnetic field sensors associated with the projectile, each sensor being arranged to provide a signal that changes in response to a relative change in position and/or orientation between the sensor and the Earth's magnetic field.

There may be two or more magnetic field sensors. Each sensor might have a different alignment in terms of magnetic field sensitivity.

The transmitter and/or receiver might comprise a directional antenna.

The electromagnetic carrier wave might have a power and/or frequency that results in a transmission ranged of less than 100 m, less than 50 m, or less than 25 m.

The system might have a transmission window or time, and/or a reception window or time of less than 100 ms, or 50 ms or less.

The frequency of the electromagnetic carrier wave, and/or the frequency of one or more sub-carriers on the carrier wave, might be re-programmable, and the transmitter might be configurable to transmit such an electromagnetic carrier wave, and/or the receiver might be configurable to receive and decode data encoded in such an electromagnetic carrier wave.

The data might comprise or be at least indicative of one or more of: priming information; and/or timing information; and/or a muzzle velocity of the projectile; and/or a particular turn count number; and/or magnetic field information; projectile firing origin information; and/or projectile firing origin information in the form or magnetic field strength information and/or magnetic field vector angle information; and/or projectile target location information; and/or projectile target location in the form or magnetic field strength information and/or a magnetic field vector angle information.

According to a fifth aspect of the invention, there is provided a ranged weapon for firing of a projectile, the ranged weapon comprising: a transmitter arranged to encode data to be transmitted to the projectile on an electromagnetic carrier wave, and to transmit that electromagnetic carrier wave to a receiver of the projectile, the data being usable in the activation of a fuse of the projectile According to a sixth aspect of the invention, there is provided a transmitter for a ranged weapon, the transmitter being arranged to encode data to be transmitted to the projectile on an electromagnetic carrier wave, and to transmit that electromagnetic carrier wave to a receiver of the projectile, the data being usable in the activation of a fuse of the projectile According to a seventh aspect of the invention, there is provided projectile for a ranged weapon, the projectile comprising: a receiver arranged to receive an electromagnetic carrier wave from a transmitter of the ranged weapon, and to decode data encoded in the electromagnetic carrier wave to retrieve that data, the data being usable in the activation of a fuse of the projectile.

According to an eighth aspect of the invention, there is provided receiver for a projectile of a ranged weapon, arranged to receive an electromagnetic carrier wave from a transmitter of the ranged weapon, and to decode data encoded in the carrier wave to retrieve that data, the data being usable in the activation of a fuse of the projectile.

According to a ninth aspect of the invention, there is provided method of communicating between a ranged weapon and a projectile for that ranged weapon, the method comprising: at the ranged weapon, encoding data to be transmitted to the projectile on an electromagnetic carrier wave, and transmitting that electromagnetic carrier wave to the projectile; at the projectile, receiving the electromagnetic carrier wave, and decoding data encoded in the electromagnetic carrier wave to retrieve that data, the data being usable in the activation of a fuse of the projectile.

According to a tenth aspect of the invention, there is provided method of transmitting data to a projectile of a ranged weapon, the method comprising: at the ranged weapon, encoding data to be transmitted to the projectile on an electromagnetic carrier wave, and transmitting that electromagnetic carrier wave to the projectile, the data being usable in the activation of a fuse of the projectile According to an eleventh aspect of the invention, there is provided method of receiving data at a projectile for a ranged weapon, the method comprising: at the projectile, receiving an electromagnetic carrier wave, and decoding data encoded in the electromagnetic carrier wave to retrieve that data, the data being usable in the activation of a fuse of the projectile.

It will be appreciated by the skilled person, from a reading of this disclosure in combination with the inherent knowledge of the skilled person, that unless clearly mutually exclusive, one or more features of any aspect of the invention might be combined with, and/or replace one or more features of any other aspect of the invention. For example, and in particular, aspects/features relating to magnetic field sensing can be used in combination with aspects/features relating to transmission of data to a projectile using a carrier wave.

Figure 2:
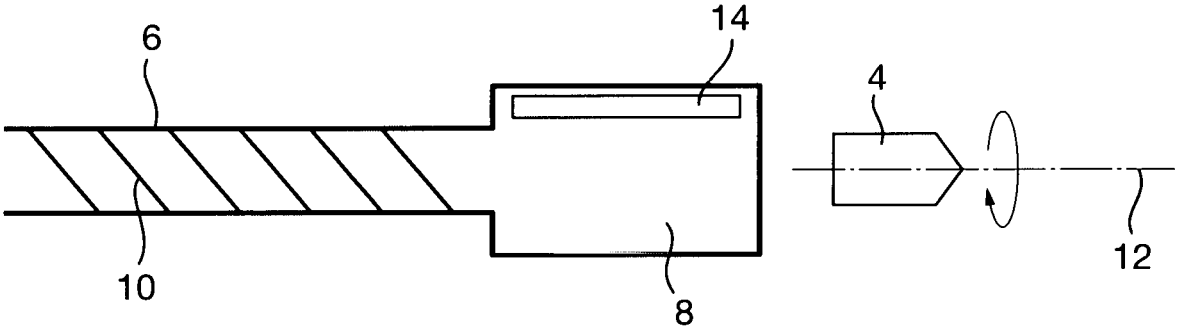
Figure 3:
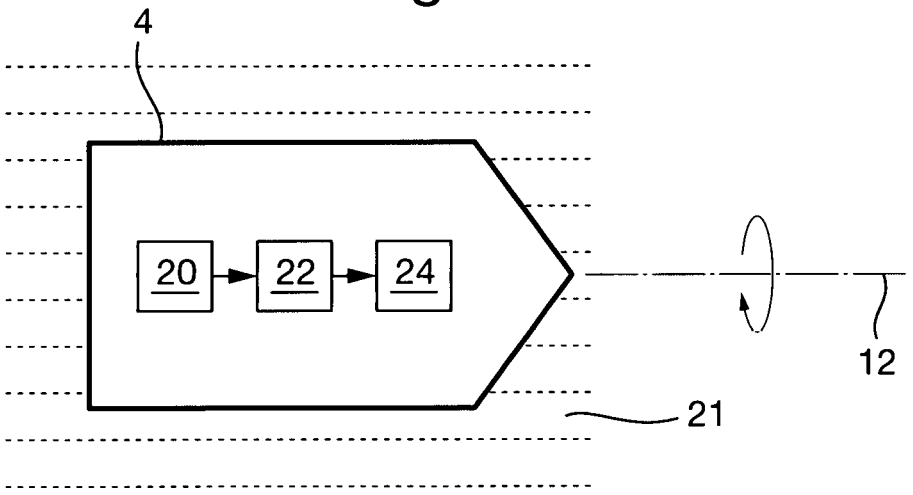
Figure 4:
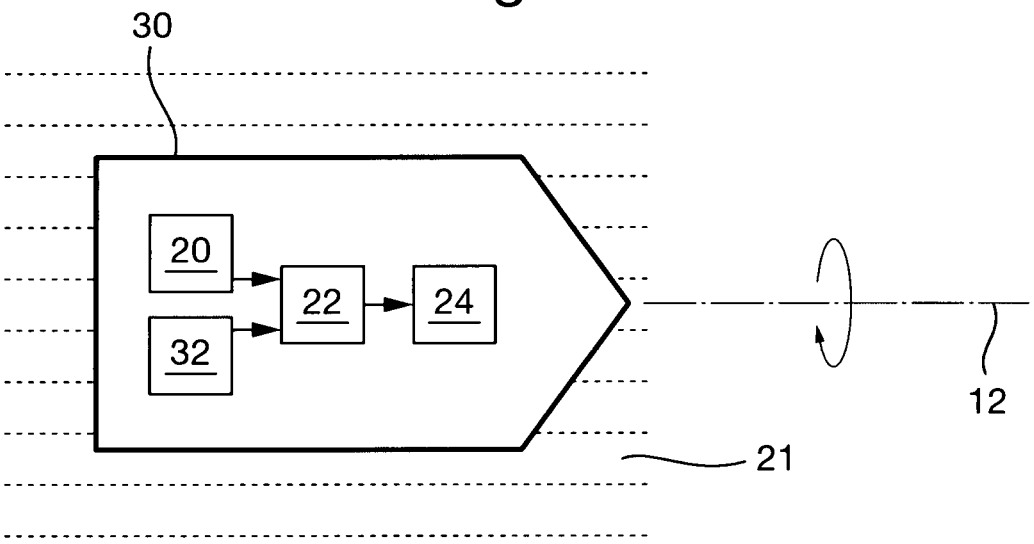
Figure 5:
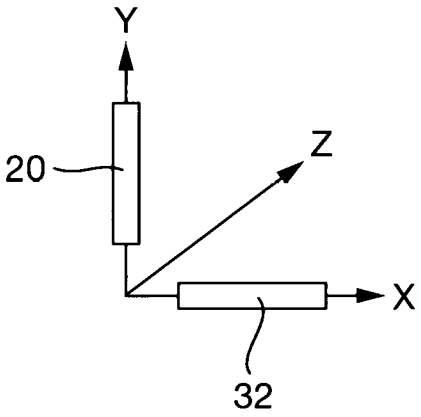
Figure 6:
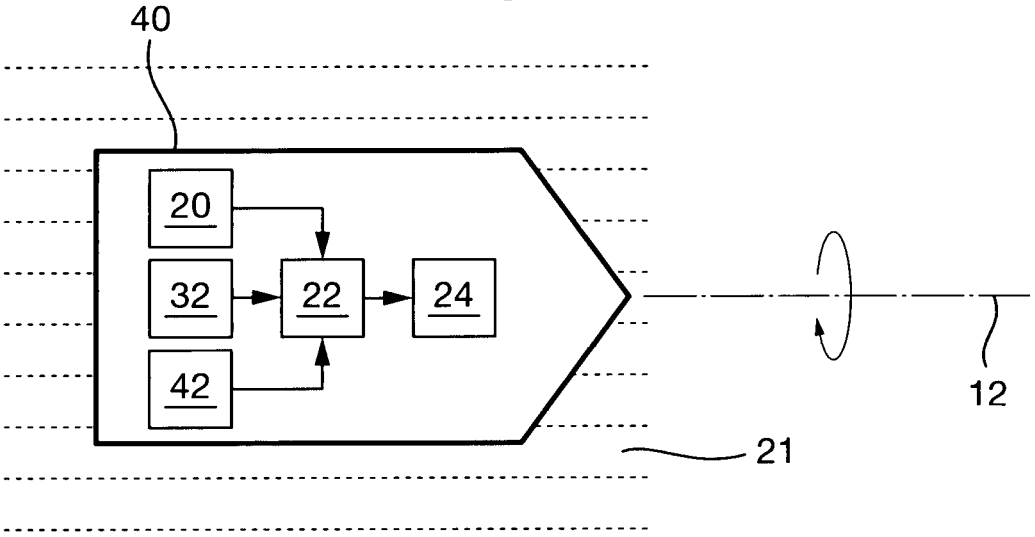
Figure 7:
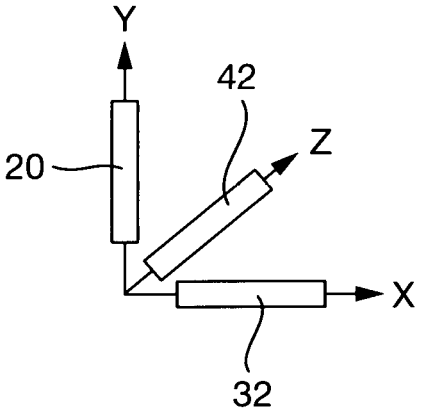
Figure 8:
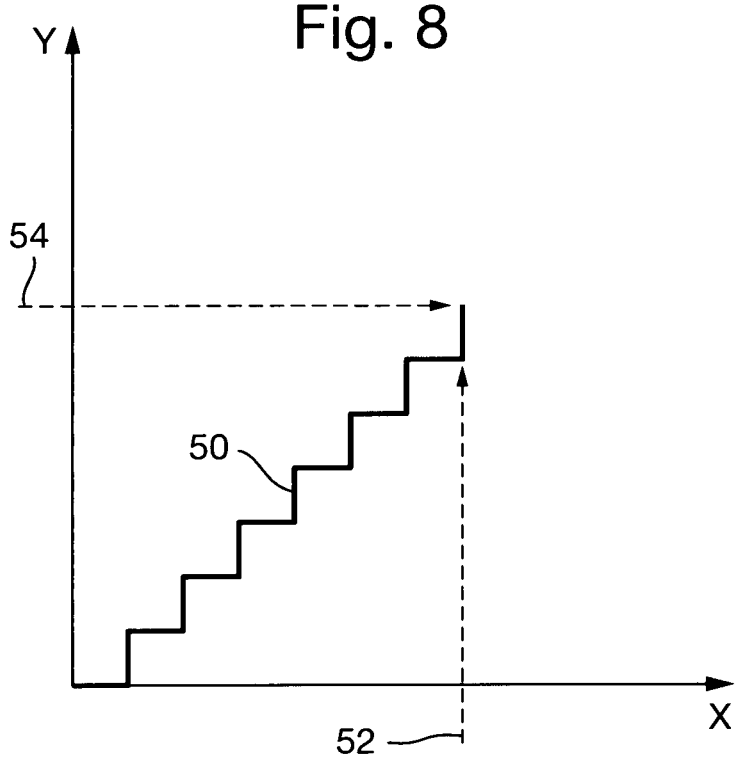
Figure 9:
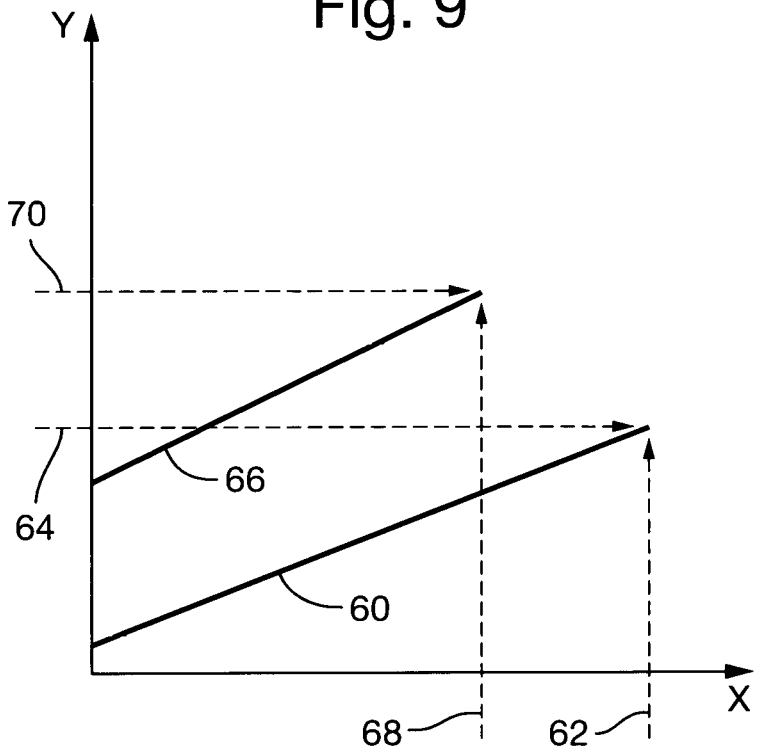
Figure 10:
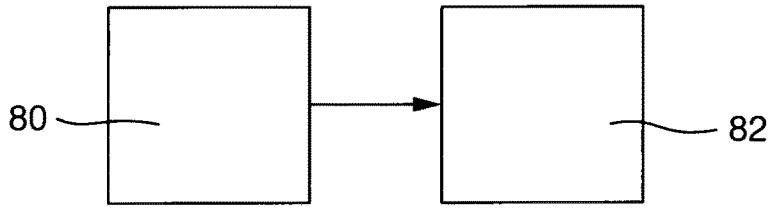
Figure 11:
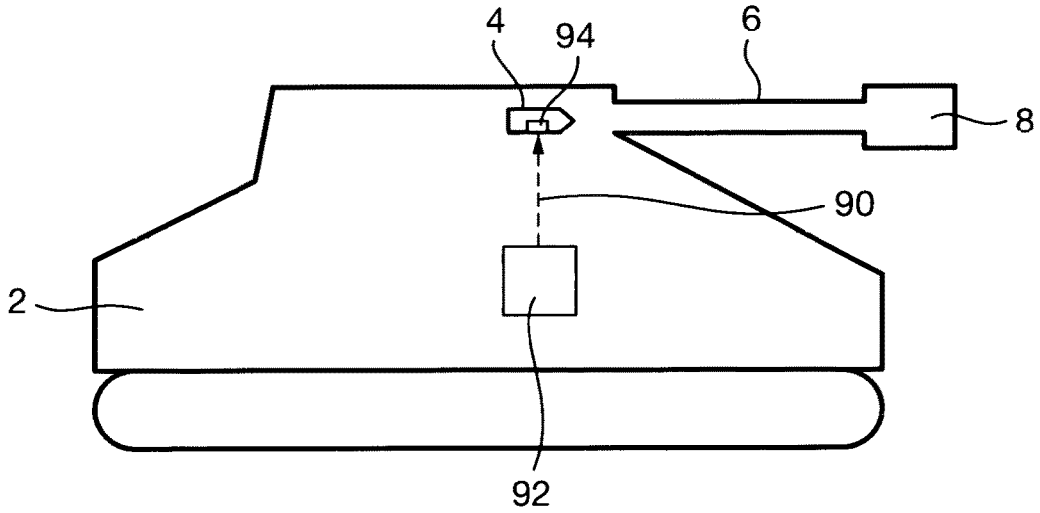
Figure 12:
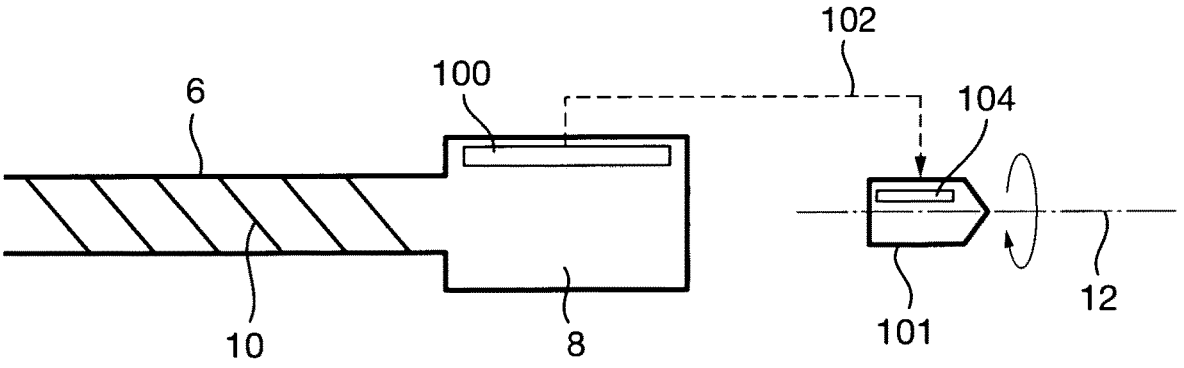
Figure 13:
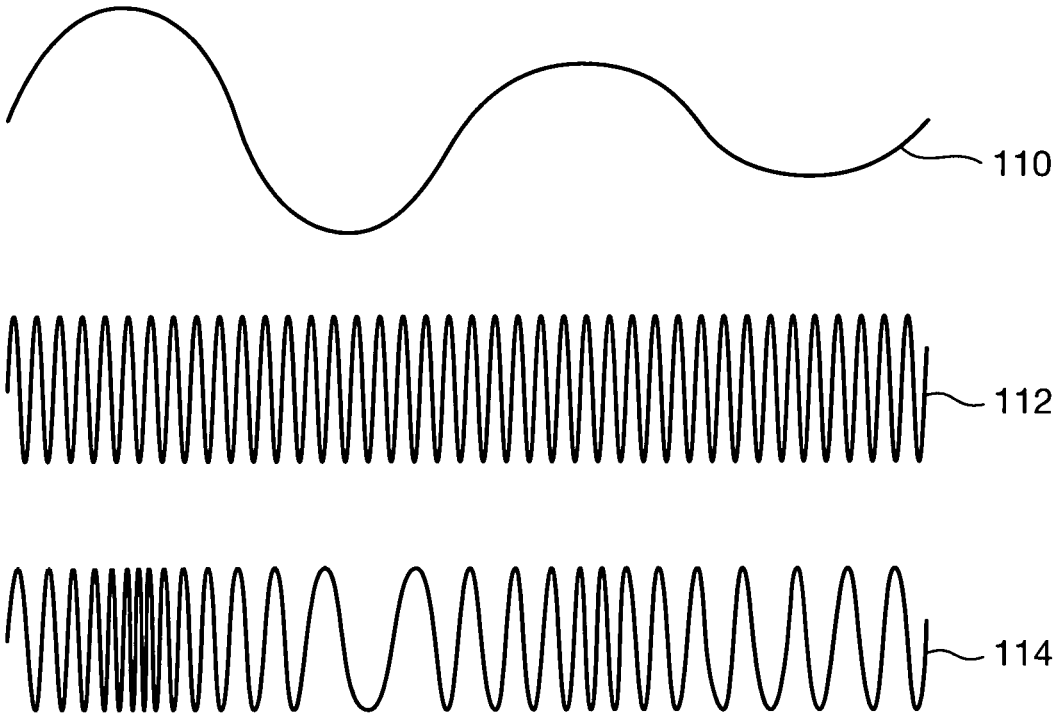
Figure 14:
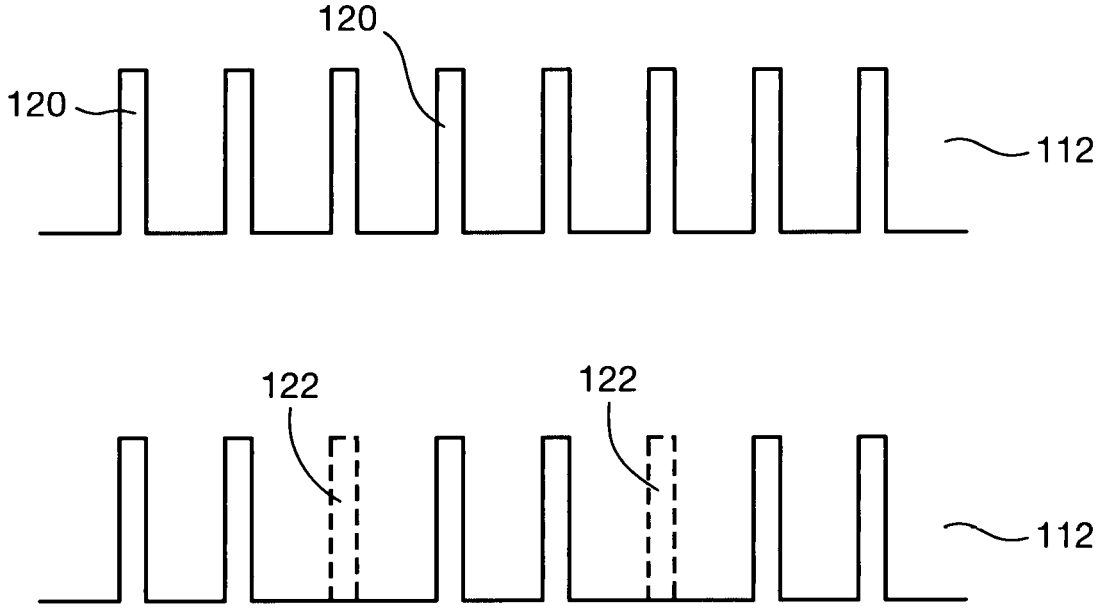
Figure 15:
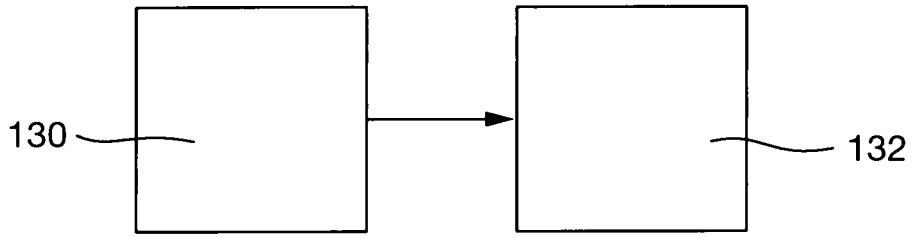
Figure 16:
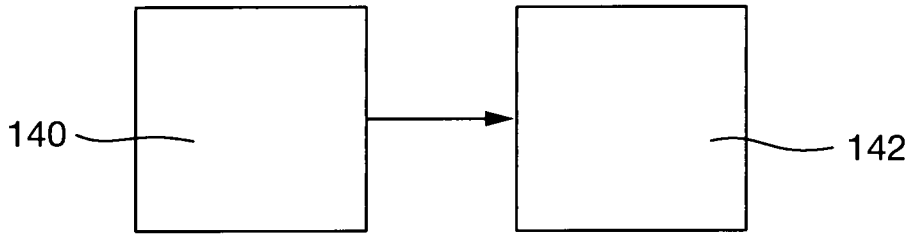
Figure 17:
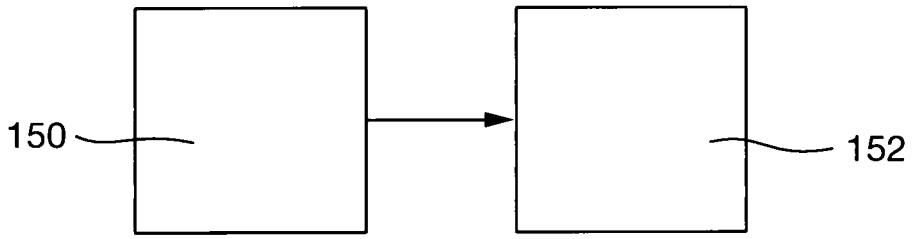

For a better understanding of the invention, and to show how embodiments of the same may be carried into effect, reference will now be made, by way of example, to the accompanying diagrammatic Figures in which:

FIG. 1 schematically depicts a ranged weapon for firing a projectile;

FIG. 2 schematically depicts principles associated with firing of a projectile from the ranged weapon of FIG. 1;

FIG. 3 schematically depicts a projectile, and apparatus for determining a rotation of the projectile about its longitudinal axis;

FIG. 4 schematically depicts a projectile according to an example embodiment, including apparatus for determining a rotation of the projectile about its longitudinal axis;

FIG. 5 schematically depicts magnetic field sensitivities of different sensors of FIG. 4, in different directions;

FIG. 6 schematically depicts a projectile according to an example embodiment, including three magnetic field sensors;

FIG. 7 schematically depicts the three sensors of FIG. 6 having magnetic field sensitivities in different directions;

FIG. 8 schematically depicts a graph showing activation of a fuse of the projectile at a particular turn-count of the projectile, equating to a particular distance from firing origin;

FIG. 9 schematically depicts a plot of sensed magnetic field properties, and activation of the fuse of the projectile at a particular magnetic field property or change therein;

FIG. 10 schematically depicts a method of activating a fuse of the projectile for a ranged weapon according to an example embodiment;

FIG. 11 schematically depicts a ranged weapon, wherein a projectile for the weapon is provided with data prior to firing of the projectile;

FIG. 12 schematically depicts transmission of data from a part of the ranged weapon, to the projectile, during and/or after firing of projectile, according to an example embodiment;

FIG. 13 schematically depicts principles associated with the data transmission to the projectile, in the context of a carrier wave and data carried on the carrier wave;

FIG. 14 schematically depicts principles associated with sub-carriers present on or absent from the carrier wave of FIG. 13; and FIGS. 15 to 17 schematically depict methods associated with the transmission or reception of a carrier wave, having encoded thereon data for use in activation of a fuse of the projectile, according to example embodiments.

FIG. 1 schematically depicts a ranged weapon 2—that is a weapon for use in firing a projectile 4, over a distance. The ranged weapon 2 in FIG. 1 is loosely depicted as a tank, but of course could take one of a number of different forms, for example artillery, self-propelled artillery, a gun battery, and so on. The ranged weapon could be fixed in position. The projectile 4 will typically be fired along a barrel 6 before leaving a muzzle 8 of the ranged weapon 2.

After firing, and once leaving the ranged weapon 2, and in particular the muzzle 8/barrel 6 thereof, the projectile 4 is completely un-propelled (in contrast with, for example, a missile or rocket or the like). That is, after firing and before impact or fuse activation, the projectile 4 is subjected only substantially to forces of gravity and/or air resistance and similar. The projectile is free from/does not comprise a propulsion system.

FIG. 2 shows that the barrel 6 is internally rifled 10 to encourage rotation of the projectile 4 about its longitudinal axis 12, the rotation improving aerodynamic stability of the projectile during its subsequent flight trajectory. As discussed above, the projectile 4 may be configured such that its fuse is activated, and such that the projectile 4 bursts or detonates or otherwise explodes on impact. However, it is sometimes desirable to ensure that the projectile 4 undergoes an air-burst, without or prior to any impact on another object. In any example, the velocity of the projectile 4 upon leaving the muzzle 8 of the ranged weapon may be important in ranging, and in particular in accurate ranging of the projectile and thus accurate targeting of objects. Muzzle velocity of the projectile 4 may be known or assumed in advance, for example from previous field trials, or calibrations, or modelling, or similar. Alternatively and/or additionally, the ranged weapon might include a muzzle velocity speed sensor 14, for determining the speed of the projectile 4 as it leaves the muzzle 8. This determined speed could perhaps be used in firing of later projectiles, where for example the sensor 14 may be used to improve the accuracy of ranging of the projectile by feeding determined speeds into a fire control or targeting system for firing of that later projectile. In examples according to the present invention, as discussed in more detail below, the muzzle velocity might actually be used in the activation of the fuse of the projectile after it has actually left the muzzle.

The muzzle velocity sensor 14 may take any particular form, and for example might be inertial, electro-magnetic, capacitive, magnetic, or any other type of sensor which is capable of determining the speed of the projectile 4 at or immediately before the projectile 4 leaves the muzzle 8.

As discussed above, an approximation of the muzzle velocity, for example a pre-determined velocity, or one assumed in advance, together with timing information, may be insufficient to ensure accurate ranging of the air-burst of the projectile. So, FIG. 3 shows how an alternative and improved approach might be to sense or otherwise detect the number of turns the projectile 4 makes about its longitudinal axis 12 during the trajectory of the projectile.

The rotational speed of the projectile 4 will be proportional to the previously described rifling of the barrel via which the projectile 4 leaves the ranged weapon 2. So, possibly in combination with some rotation rate decay calibration (e.g. to account for air resistance or similar), the number of rotations (known as the turn-count) can be used to determine how far the projectile has travelled from a firing origin location. Consequently, the turn-count can be used to determine at what turn-count number, and so at what distance, the projectile 4 should be made to explode or otherwise burst.

In an already proposed approach, the projectile 4 might comprise a magnetic field sensor 20. The magnetic field sensor is arranged to provide a signal that changes in response to a relative change in position and/or orientation between the sensor 20 and the Earth's magnetic field 21. This signal can be fed to a controller being or comprising a turn-counter 22. When a particular turn-count is determined, which will equate to a particular distance the projectile 4 has travelled, the controller 22 can activate a fuse of the projectile to initiate air-burst or otherwise explosion of the projectile 4.

The sensor 20, controller 22, and fuse 24 might be described as cumulatively forming a fuse system for the projectile 4. In certain circumstances, the fuse system may function sufficiently accurately for accurate air-burst and thus accurate ranging to be implemented in practice. However, such accurate implementation may depend very much on the relative orientations between the projectile 4, the magnetic field sensor 20 thereof, and the configuration (for example field strength or vector angle) of the Earth's magnetic field 21. For instance, the system of FIG. 3 depends on detecting changes relative to the Earth's magnetic field, and that field 21 has relatively low strength (for example 25-65 μT), and more particularly very small changes thereof will need to be detected (for instance, changes of 0.1%, or in the range of 25-65 nT). Depending on the field strength and vector angle, in some instances the magnetic field sensor 22 may not be able to pick up or otherwise sense a change relative to the field 21 that is indicative of or reflects one or more turns of the projectile 4 about its longitudinal axis.

For example, problems with sensing might occur when the rotation of the projectile is along or about a particular field line/vector angle. This problem may not be that significant when the sensor is only unable to detect relative magnetic field changes for a relatively short period of time in the trajectory of the projectile. For instance, if there is only a short period of time during which no sensing is possible, then the fuse system may simply be able to assume that a certain number of turns has taken place during that period of time, and add these to the overall turn-count that is being undertaken. However, if the lack of sufficient sensing occurs for a prolonged period of time, for example a substantial portion, a majority or even all of the flight trajectory, then it simply may not be possible to determine the turn-count with any decent accuracy. If a turn-count cannot be determined with any particular accuracy, then the activation of the fuse can also not be implemented with any particular accuracy. Thus, although the arrangement of FIG. 3 may work in some circumstances, improvements can certainly be made.

According to an example embodiment, it has been realised the many of the problems of previously proposed approaches to activating the fuse of a projectile based on magnetic fields can be largely overcome by employing at least a second magnetic field sensor. This at first might appear to be a trivial change. However, according to an example embodiment, the two (or more) magnetic field sensors are not arbitrarily present to provide, for example, redundancy in the event of failure of one of the sensors. Instead, the magnetic field sensors are arranged or otherwise configured such that each sensor has a different alignment in terms of magnetic field sensitivity. It is this requirement that is subtle, but extremely important and advantageous. This is because the simple but effective additional requirements imposed on the directional sensitivity of the second (or subsequent) sensor ensures that the problems previously described are largely avoided. That is, if one sensor is unable to detect changes in the Earth's magnetic field as the projectile passes through the field and rotates within it, for example due to the sensing being along an unchanging field line or similar, then the other sensors, aligned in a different direction with respect to magnetic field sensitivity will, of course, actually pick up a different signal. This means that changes in orientation and/or position of the projectile, having such multiple sensors, can be determined far more accurately or reliably than when only a single sensor is used. Consequently, this means that the turn-count obtained via signals from the sensor, or any measurement obtained from the sensor, may be used to more accurately and reliably activate a fuse, and therefore more accurately determine the ultimate targeting of the projectile.

FIG. 4 schematically depicts a projectile 30 according to an example embodiment. While the projectile 30 might still comprise a (first) magnetic field sensor 20, a controller 22 and a fuse 24, as with the projectile of FIG. 3, the projectile in FIG. 4 now comprises an additional (second) magnetic field sensor 32. Again, and importantly, the magnetic field sensors 20, 32 have different alignments in terms of magnetic field sensitivities. Different alignments could equate to similar or identical sensors being physically aligned in different directions, or being physically aligned in the same directions and having sensitivities to magnetic fields in different directions.

FIG. 5 shows how the magnetic field sensors 20, 32 may have their magnetic field sensitivities aligned relative to one another. An advantageous arrangement, shown in FIG. 5, might be when the sensitivities are orthogonal to one another since this might maximise the detectable differences in magnetic field properties through which the sensors and/or projectile pass or are exposed to.

FIG. 6 shows that, in another example embodiment, a projectile 40 or more particularly a fuse system thereof, might comprise a further (third) magnetic field sensor 42. This might provide even further gains in accurately or consistently determining relative changes in position/orientation between the projectile 40 and the magnetic field 42. FIG. 7 shows that an advantageous arrangement might be when the sensitivities to magnetic fields of the sensors 20, 32, 42 are, again, orthogonally aligned with respect to one another.

While the use of a third sensor 42 might improve accuracy with regard to, for instance, turn-count determination, a third sensor, particularly in the orthogonal arrangement of FIG. 7, might also allow for more sophisticated (or at least alternative) navigation/location-based fuse activation methods to be employed, as discussed in more detail below.

As already alluded to above, the sensors that form part of the fuse system will need to be capable of detecting sufficiently small changes in relative magnetic field strengths for any measurements to take place, and/or for the results to be used in the activation of the fuse. Given that the sensing is being undertaken relative to the Earth's magnetic field, the sensors will typically need to be capable of detecting fields in the ranged of 25-65 μT, and/or changes therein in the regional of 25-65 nT. This might require the use of an active magnetic field sensor, for example a fluxgate sensor or a magnetoresistive sensor, as opposed to for example a Hall Effect sensor or similar.

FIG. 8 is a basic graph schematically depicting one use of the two-sensor fuse system described above. The x-axis depicts a turn-count of the projectile. The y-axis depicts a related distance that the projectile has travelled in relation to the turn-count. A representation of a sensed or measured turn-count 50 is also shown. It can be seen that at a particular turn-count 52, the projectile will have travelled a particular distance 54 and therefore the fuse might be activated at this particular turn-count, at this particular distance, to achieve explosion or air-burst or similar of the projectile at that distance.

The representation of the turn-count 50 is shown as progressing in a regular step-wise manner. In practice, there may be some decay in the turn-count with increasing distance travelled by the projectile. This might be dependent on environmental conditions, for example, weather, humidity, wind, air resistance, and so on. One, more of these properties, or at least a typical rotation frequency decay rate, can be pre-programmed or built into the controller of the fuse system, so such decay can be taken into account when calculating distance travelled for a particular turn-count, or calculating the particular turn-count for a certain distance.

As with many applications, in particular when sensing of very small changes has been undertaken, there may be significant noise in the sensing, or the signals generated as a result of the sensing. In the present examples, problems associated with such noise might result in it being difficult to determine a particular turn-count accurately or consistently, or similar. However, the typical rotation rates will be known in advance, at least within a particular range. For instance, a typical projectile fired by a tank might involve a spin speed of a few hundred Hz. Therefore, the controller of the fuse system may be arranged to apply a band pass filter and/or a phase locked loop filter to the signals received from the sensors, to at least partially filter out signals outside of a turn frequency range of interest, for example outside of the expected turn-count frequency, or a window or range about that frequency.

As mentioned above, the use of two magnetic field sensors that have their magnetic field sensor activities aligned in different directions overcomes many of the problems associated with the use of a single sensor. At the same time, sensing the field in different directions has additional benefits. In particular, using two sets of sensors, and in particular three sets of sensors, it may be possible to infer a particular change in location of the projectile from the one or more received signals received from the sensors. It is then, of course, possible to have the controller activate the fuse when the particular change equates to the projectile being at a target location. The change could, for instance, be a relative or absolute change, for example the fuse being activated when the field strength is 'x' or a magnetic field vector angle is 'y', and/or the fuse could be activated when a particular change in such values is determined. Sensing, measurements or fuse activation might be undertaken, again, absolutely, or relative to a background or baseline reference, for example one or more values at the firing origin of the projectile.

With magnetic field mapping of the environment in which the projectile is fired and in which the target location or object is positioned, the fuse system may be able to effectively infer (i.e. deduce or determine) a pseudo-navigational determination of the projectile location. Such a determination of navigation-like properties, or location information, might have use in isolation, for example the fuse being activated when the projectile is determined to be in a particular location. This might be used in combination with, for example, a turn-count for validation or verification purposes. Also, measuring navigational changes relative to the Earth's magnetic field may be advantageous over, for example, transmitting location information or coordinates or the like to the projectile, for example via a GPS system or similar, which could of course be jammed or otherwise interrupted.

FIG. 9 shows a basic graph schematically depicting a change in magnetic field property along the x-axis and, for instance, a related change in distance from firing origin of the projectile in the 'y' axis. Although only crudely depicted, the graph nevertheless schematically depicts how a navigational-like feature may be realised according to an example embodiment of the present invention. For example, a sensed magnetic field strength 60 may vary through the projectile's trajectory, and at a particular strength 62 or change therein equate to a particular distance from the firing origin 64 which is a target distance. At this distance, the projectile's fuse might be activated.

A similar change in magnetic field vector angle 66 may be sensed. At a particular angle 68 or change therein, equating to a particular distance 70 from the firing origin, the fuse might be activated at a required target location.

Again the graph in FIG. 9 is simplistic, and in reality more complex implementation may be realised, for example detecting the relative changes in field strength in more than one axis or in more than one direction, and similarly the change in vector angle in more than one axis and more than one direction. Nevertheless, FIG. 9 and related description shows how location information can be obtained via magnetic field sensing, and this information can be used to activate a fuse of a projectile.

Of course, a projectile that has not been fired from the weapon will also be subjected to relative changes in magnetic field properties. Therefore, the fuse system may only be activated during or after the firing procedure. The magnetic field sensors may detect a change in sensed field properties as the projectile leaves the barrel/muzzle, and this might be used to prime or otherwise change the state of the fuse system. Of course, other methods may be used, for example an inertial primer.

FIG. 10 is a flow chart schematically depicting an overview of a method relating to the apparatus already described. As discussed above, the method relates generally to activating a fuse for a projectile for a ranged weapon. The method comprises using a plurality of magnetic field sensors of the projectile to provide one or more signals that change in response to a relative change in position and/or orientation between the projectile and the Earth's magnetic field 80. Each sensor has a different alignment in terms of its magnetic field sensitivity. The method then comprises activating the fuse of the projectile depending on the received one or more signals 82.

As discussed above, it may be that a projectile is set to burst or otherwise explode at a particular distance from a firing origin, and that distance might be determined based on a muzzle velocity, a time from firing, a turn-count, or a combination thereof. It might be desirable, or in some instances even necessary, to provide one or more of these properties or values, or at least data indicative thereof, to the projectile. This is to ensure that the projectile or a controller thereof is capable of ensuring burst of otherwise explosion at a particular distance or location. FIG. 11 shows how such data 90 may be transferred from a data store 92 or other system of the ranged weapon 2, to a data receiver or storage 94 or other system of the projectile 4. The data 90 is for use by that projectile 4 in, for instance, activation of a fuse therein. The data 90 might be transferred by inductive coupling, or via electrical contacts or similar.

In some instances, the transfer of data in the manner shown in FIG. 11 may be sufficient in terms of data transfer rate, the nature of data that is transferred, and how the data is transferred. However, in some instances it may not be possible or practical to transfer important up-to-date data to the projectile 4 immediately before filing, or perhaps more importantly and in certain scenarios, after filing. Such up-to-date information, for example, might be used to take into account variables that might have changed from the time at which the projectile 4 was stored, and data could have been transferred to the projectile as shown in FIG. 11, and a time at which the projectile is ready to be fired, during the firing and perhaps even after the firing.

According to an example embodiment, one or more of the problems discussed above may be at least partially overcome by transmitting, or having the capability of transmitting, data from the ranged weapon to the projectile during the firing process, or even after the firing process when the projectile would have left the ranged weapon. One approach might be to use a wireless network to achieve such data transfer—i.e. Wi-Fi or similar. However, the time needed to initiate such a system, transfer data and decode and use such data in the projectile may be too long to be of any practical use, or even for the data to be received in the first place. That is, the speed at which a projectile might be fired might be such that it would be extremely difficult if not impossible to use Wi-Fi like networking to transfer data to the projectile. Thus, in accordance with an example embodiment, a carrier wave is encoded with data, and the carrier wave is transmitted to the projectile. The carrier wave can be generated, transmitted, received and de-coded using relatively simple technology that is reliable, cheap and extremely efficient in terms of speed of data processing. This allows data to be transferred to, and processed by, the projectile even after firing of the projectile.

FIG. 12 shows that the ranged weapon has an associated transmitter 100. The transmitter 100 is shown as being located in the muzzle 8 of the ranged weapon, but could of course be located in any other appropriate part of the ranged weapon, for example the main body of the ranged weapon, or a movable turret, and so on.

The transmitter 100 is arranged to encode data to be transmitted to the projectile 101 on an electromagnetic carrier wave, and to then transmit that electromagnetic carrier wave 102 to the projectile 101. The projectile 101 has an associated receiver 104, the receiver being arranged to receive the electromagnetic carrier wave 102 and to decode data encoded in the electromagnetic carrier wave to retrieve that data. As mentioned previously, the data is typically usable in the activation of a fuse of the projectile 101.

FIG. 13 schematically depicts basic principles associated with the use and operation of carrier waves. A signal to be transmitted is shown 110. A carrier wave having a particular frequency is also shown 112. In a preferred example the carrier wave 112 is frequency modulated in relation to the signal 110 to be transmitted, thus resulting in a frequency modulated carrier wave 114. Frequency modulation being preferred over, for instance, amplitude modulation in terms of the enhanced data transmission capabilities associated with frequency modulation.

The nature of data to be transmitted may not be particularly complex, for example involving images, or video, or large streams of data. Instead, the data might be relatively simple, for example comprising only a single number in the form of a turn-count, or a muzzle velocity, or a target magnetic field strength or vector angle. As a result, the frequency modulation or similar may not need to be particularly complex in order to achieve the desired result of quickly and easily transmitting relatively small amounts of data to the projectile. Therefore, in a preferred example, data to be transmitted may be encoded in what could be described as binary form, and in particular by the presence or absence of particular sub-carriers (sometimes known as sub-channels) on the carrier wave (that is, relatively simple (frequency-division multiplexing).

FIG. 14 depicts in very simplistic and somewhat abstract terms how the carrier wave 112 might comprise a certain number of sub-carriers, for example at different frequencies. By these sub-carriers being present 120 or absent 122, simple binary encoding is relatively easy to implement and subsequently decode. For instance, with only eight sub-carriers or sub-channels, there are eight bits of data that can be transmitted effectively, continuously and in parallel on the carrier wave 112, meaning that the projectile is readily able to receive the code and act upon the date encoded in the carrier wave. An analogy might be that the transmitter plays a particular note, chord or tone and the projectile is ready and able to receive and act upon that note, chord or tone. That is, there may be no need to actually encode data or further data in the sub-carriers—the actual presence or absence of the sub-carriers is all that is required to transmit the data that was required for the particular application/fuse activation.

A controller of the projectile, for example the controller discussed above, many use the received data in the activation of the fuse as and when appropriate. This might be used independently of or in conjunction with, any magnetic field sensing that has been undertaken within the projectile or, for example, the turn-count or navigation-like functionality described above.

The data might take any particular form depending of course on the application and nature of the fuse system, and projectile and its intended use. Typical examples might include priming information, which might provide the projectile with an indication that the projectile has left the barrel, and for at least a part of the fuse system to be readied, or for a countdown time or similar to begin. Alternatively and/or additionally the magnetic field sensors might be able to provide such information, since it is expected that a magnetic field sensor should be able to readily detect changes in relative magnetic field as the projectile leaves the barrel/muzzle of the ranged weapon. The data might comprise timing information, for example a time to detonate or burst of the projectile. The data might comprise a muzzle velocity, which might also be used in calculating a range, or a time to burst or a burst location or similar. In another example, the magnetic field sensors may be used in the calculation of muzzle velocity, since a measured rotational rate of the projectile via the use of the sensors, in combination with a known rifling pitch, should allow for a velocity to be determined. In this case, a sensed or transmitted/received muzzle velocity could be used in isolation or possibly in combination with validation/verification benefits. The data might comprise a particular turn-count number, at which number the projectile is set to burst or detonate. Magnetic field information might be transmitted, for example field strengths, changes therein, vector angles, or changes therein, and so on. Projectile firing origin information might be transmitted, for example in terms of a condition at the origin in terms of ambient measurement of temperature or wind speed and so on or, in particular to the embodiments described above, in the form of magnetic field strength information and/or magnetic field vector angle information. The same sort of data (e.g. environmental conditions) could be transmitted relative to the projectile target location.

As discussed above, depending on the embodiments and applications of the invention, some or all of this data or similar might be pre-stored in the projectile before firing, and/or transmitted to the projectile during or after firing, or a combination thereof. Data that is transmitted might be used to supplement data that is stored, or verify or validate stored data. Transmitted data might provide data that is impossible or impractical to pre-store, for example data of targets that have changed just before, during or after projectile firing. Also, the data might not necessarily be the information described above, but instead be indicative thereof. For instance, the data that is transmitted might not actually be a numerical value that actually equates to a particular turn-count number of field strength, but could be data that simply is indicative of that number or that field strength that would be readily understood and processed by the projectile fuse system.

Pre-stored and/or received data may be stored in any convenient manner, for example volatile or non-volatile memory.

Of course, the transmission of such data in a wireless manner might be open to reception and inspection by unintended third parties, or possibly even result in interference by such third parties, or interference in general. Additionally and/or alternatively, such wireless transmission/reception can result in crosstalk between ranged weapons/projectiles in proximity to one another. Therefore, the aforementioned transmitter and/or receiver may comprise one or more directional antennae. The directional antennae may prevent transmission of a signal in, or reception of a signal from, any and all directions, but instead transmission/reception in a particular direction. This might limit potential cross-talk and/or eavesdropping. Similarly, the electromagnetic carrier wave might have properties (e.g. have a power and/or frequency) that results in a transmission range (e.g. in air) of less than 100 metres or less than 50 metres, or less than 25 metres, for instance approximately 10 metres. Within this distance, and by the use of carrier waves, sufficient data may be transmitted to the projectile to be used in the fuse system as described above, and no more data might need to be transmitted towards or received by the projectile in order to perform fuse activation at the appropriate time. So, with such a short transmission range, the risks of cross-talk, eavesdropping and/or jamming is also significantly reduced. For instance a suitable carrier wave frequency might be of the order of GHz, for instance approximately 10 GHz and above, particularly at or around high attenuation peaks. Near field communications could also be used. For similar reasons, the communication system described above might have a transmission window, and/or a reception window, of less than 100 ms or 50 ms or less, again to limit the risks of cross-talk, eavesdropping and/or jamming.

The actual details of the transmission and reception hardware are not described in particular detail herein, largely because types of apparatus will be known to and understood by the skilled person after a reading of this disclosure. It is the particular use of that apparatus in this application where the advantages lie, as already described. For instance, data transmission might be achieved via digital synthesis methods, or via so-called software radio techniques. Decoding at the receiver could be via analogue methods, for example a filter array feeding a number of digital latches. Alternatively, digital signal processing techniques (e.g. Fast Fourier Transforms or active filters) may be employed, since these may provide greater selectivity (e.g. enabling more efficient use of bandwidth or a greater number of sub-channels or sub-carriers), robustness to interference and the potential to re-programme the system if changes are required (e.g. different sub-channels or carrier frequencies are required, due to a security breach, or to make such a security breach harder to implement). As already discussed above parallel decoding in a continuous manner would allow near instantaneous transfer of the required data, meaning that even at muzzle velocity the projectile can still receive and decode data transmitted from the ranged weapon.

FIG. 15 schematically depicts a method which summarises some of the communication principles discussed above. The method relates to communication between a ranged weapon and a projectile for that ranged weapon. The method comprises, at the ranged weapon, encoding data to be transmitted to the projectile on an electromagnetic carrier wave, and transmitting that electromagnetic carrier wave to the projectile 130. Next, at the projectile, the method comprises receiving the electromagnetic carrier wave, and decoding data encoded in the electromagnetic carrier wave to retrieve that data 132. The data is usable in the activation of the fuse of the projectile, at least in typical embodiments.

FIG. 16 describes the related method (or method portion) of transmitting data to a projectile of a ranged weapon. The method comprises, at the ranged weapon, encoding data to be transmitted to the projectile on an electromagnetic carrier wave 140, and then transmitting that electromagnetic carrier wave to the projectile 142. Of course, these steps might be undertaken by the same hardware or software, and be undertaken effectively at the same time. Similarly, FIG. 17 shows a method of receiving data at a projectile for a ranged weapon. The method comprises, at the projectile, receiving an electromagnetic carrier wave 150, and then decoding data encoded in the electromagnetic carrier wave to retrieve that data 152. The data is usable in the activation of a fuse of the projectile in most embodiments.

In the description of the apparatus above, some components have been described and shown as being separate, for example a magnetic field sensor, and a controller, and a fuse. This is only for ease of understanding of the invention, and in other or working examples one or more of the components might be used in combination, be present in the same piece of electronics or software and so on. This is also true where methods have been described, where methods might be described in a step-wise manner for clarity of understanding, but in other or working examples one or more parts of the method might be undertaken in combination, or substantially at the same time, for example the date encoding and transmission described previously, or the reception and decoding described previously.

The apparatus described above might be completely new apparatus, or existing apparatus re-configured to work in the new and beneficial manner described above. For example, a new ranged weapon might comprise the transmitter described above, or an existing ranged weapon might be retro-fitted with such a transmitter, and so on.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A communication system for communicating between a ranged weapon and a projectile for that ranged weapon, the system comprising:

a transmitter associated with the ranged weapon, the transmitter configured to encode data in binary form and to transmit the encoded data to the projectile on an electromagnetic carrier wave, the data including a first binary value encoded as a presence of a first sub-carrier on the electromagnetic carrier wave and a second binary value encoded as an absence of a second sub-carrier on the electromagnetic carrier wave, wherein the first binary value is different from the second binary value;

a receiver associated with the projectile, the receiver configured to receive the electromagnetic carrier wave including at least one of the first sub-carrier and the second sub-carrier, and to decode the data encoded in the electromagnetic carrier wave, the data for use in the activation of a fuse of the projectile.

2. The communication system of claim 1, wherein the receiver is configured to decode the data by detecting the presence of the first sub-carrier while receiving the electromagnetic carrier wave and/or by detecting the absence of the second sub-carrier while receiving the electromagnetic carrier wave.

3. The communication system of claim 1, further comprising a controller associated with the projectile, the controller configured to activate the fuse of the projectile using the received data.

4. The communication system of claim 3, further comprising one or more magnetic field sensors associated with the projectile, wherein the controller is configured to activate the fuse of the projectile using one or more signals received from the one or more magnetic field sensors associated with the projectile, each of the one or more magnetic field sensors configured to provide the one or more signals that change in response to a relative change in a position of the one or more magnetic field sensors and/or an orientation between the one or more magnetic field sensors and a magnetic field.

5. The communication system of claim 4, further comprising two or more magnetic field sensors, each having a different magnetic field sensitivity alignment.

6. The communication system of claim 1, wherein the transmitter comprises a directional antenna, or the receiver comprises a directional antenna, or the transmitter comprises a first directional antenna and receiver comprises a second directional antenna.

7. The communication system of claim 1, wherein the electromagnetic carrier wave has a power and/or a frequency that results in a transmission range of less than 100 meters.

8. The communication system of claim 1, wherein the system has a transmission window of less than 100 milliseconds and/or a reception window of less than 100 milliseconds.

9. The communication system of claim 1, wherein a frequency of the electromagnetic carrier wave, and/or a frequency of one or more sub-carriers on the electromagnetic carrier wave, is re-programmable, and the transmitter is configurable to transmit the electromagnetic carrier wave, and/or the receiver is configurable to receive and decode data encoded in the electromagnetic carrier wave.

10. The communication system of claim 1, wherein the data comprises or is at least indicative of one or more of:

priming information; and/or
timing information; and/or
a muzzle velocity of the projectile; and/or
a particular turn count number; and/or
magnetic field information; and/or
projectile firing origin information; and/or
projectile firing origin in the form of magnetic field strength information; and/or
projectile firing origin in the form of magnetic field vector angle information; and/or
projectile target location information; and/or
projectile target location in the form of magnetic field strength information; and/or
projectile target location in the form of a magnetic field vector angle information.

11. A ranged weapon for firing of a projectile, the ranged weapon comprising:

a transmitter configured to encode data in binary form and to transmit the encoded data to the projectile on an electromagnetic carrier wave, the data including a first binary value encoded as a presence of a first sub-carrier on the electromagnetic carrier wave and a second binary value encoded as an absence of a second sub-carrier on the electromagnetic carrier wave, wherein the first binary value is different from the second binary value, the data for use in the activation of a fuse of the projectile.

12. A projectile for a ranged weapon, the projectile comprising:

a receiver configured to receive an electromagnetic carrier wave from a transmitter of the ranged weapon, and to decode data encoded in the electromagnetic carrier wave to retrieve that data, the data including a first binary value encoded as a presence of a first sub-carrier on the electromagnetic carrier wave and a second binary value encoded as an absence of a second sub-carrier on the electromagnetic carrier wave, wherein the first binary value is different from the second binary value, the data for use in the activation of a fuse of the projectile.

13. A method of communicating between a ranged weapon and a projectile for that ranged weapon, the method comprising:

at the ranged weapon, encoding data in binary form to be transmitted to the projectile on an electromagnetic carrier wave, and transmitting that electromagnetic carrier wave to the projectile, the data including a first binary value encoded as a presence of a first sub-carrier on the electromagnetic carrier wave and a second binary value encoded as an absence of a second sub-carrier on the electromagnetic carrier wave, wherein the first binary value is different from the second binary value; and at the projectile, receiving the electromagnetic carrier wave including at least one of the first sub-carrier and the second sub-carrier, decoding data encoded in the electromagnetic carrier wave to retrieve the data, and activating a fuse of the projectile using the data.

14. The communication system of claim 1, wherein the electromagnetic carrier wave has a power and/or a frequency that results in a transmission range of less than 50 meters.

15. The communication system of claim 1, wherein the electromagnetic carrier wave has a power and/or a frequency that results in a transmission range of less than 25 meters.

16. The communication system of claim 1, wherein the system has a transmission window of 50 milliseconds or less and/or a reception window of 50 milliseconds or less.

17. The ranged weapon of claim 11, wherein the presence of the first sub-carrier and/or the absence of the second sub-carrier is programmed based on a range to a target.

18. The projectile of claim 12, wherein the receiver is configured to decode the data by detecting the presence of the first sub-carrier while receiving the electromagnetic carrier wave and/or by detecting the absence of the second sub-carrier while receiving the electromagnetic carrier wave.

19. The projectile of claim 12, further comprising a controller to activate the fuse of the projectile using the received data.

20. The projectile of claim 19, wherein the controller activates the fuse of the projectile using one or more signals received from one or more magnetic field sensors associated with the projectile, each of the one or more magnetic field sensors configured to provide the one or more signals in response to a relative change in a position of the one or more magnetic field sensors and/or an orientation between the one or more magnetic field sensors and a magnetic field.

* * * * *